US009649759B2

(12) United States Patent
Ubeto

(10) Patent No.: US 9,649,759 B2
(45) Date of Patent: May 16, 2017

(54) TOOTHBRUSH WITH AN EXTENDABLE HANDLE

(71) Applicant: German J. Ubeto, Miami Beach, FL (US)

(72) Inventor: German J. Ubeto, Miami Beach, FL (US)

( * ) Notice: Subject to any disclaimer, the term of this patent is extended or adjusted under 35 U.S.C. 154(b) by 0 days.

(21) Appl. No.: 15/391,688

(22) Filed: Dec. 27, 2016

(65) Prior Publication Data

US 2017/0106524 A1 Apr. 20, 2017

Related U.S. Application Data

(63) Continuation-in-part of application No. 15/006,323, filed on Jan. 26, 2016, now abandoned, which is a continuation of application No. 14/554,921, filed on Nov. 26, 2014, now Pat. No. 9,248,564.

(51) Int. Cl.

| | |
|---|---|
| ***B25G 1/04*** | (2006.01) |
| ***A46B 5/00*** | (2006.01) |
| ***A46B 15/00*** | (2006.01) |
| ***A46B 9/04*** | (2006.01) |
| ***A46B 11/00*** | (2006.01) |

(52) U.S. Cl.

CPC ..... *B25G 1/04* (2013.01); *A46B 5/005* (2013.01); *A46B 9/04* (2013.01); *A46B 11/0003* (2013.01); *A46B 15/0071* (2013.01); *A46B 15/0093* (2013.01); *A46B 15/0095* (2013.01); *A46B 2200/1066* (2013.01)

(58) Field of Classification Search

CPC . A46B 5/005; A46B 15/0071; A46B 15/0095; B25G 1/04

See application file for complete search history.

(56) References Cited

U.S. PATENT DOCUMENTS

| | | | |
|---|---|---|---|
| 1,166,269 | A | 12/1915 | Smith |
| 1,646,082 | A | 10/1927 | Dailey |
| 2,641,012 | A | 6/1953 | Storrs |
| 3,188,675 | A | 6/1965 | Beck |
| 4,135,274 | A | 1/1979 | Freeman |
| 4,866,809 | A | 9/1989 | Pelletier |
| 6,726,011 | B2 | 4/2004 | Sarkar |
| 2003/0080021 | A1 | 5/2003 | Kopecky |
| 2004/0182733 | A1 | 9/2004 | Dunlap |
| 2004/0187241 | A1 | 9/2004 | Katz |
| 2011/0041272 | A1 | 2/2011 | Prencipe |

*Primary Examiner* — Randall Chin

(74) *Attorney, Agent, or Firm* — Spencer Fane LLP

(57) ABSTRACT

A toothbrush includes a head with an extendable handle. The toothbrush has a brush head with bristles extending from one side, and an opening containing one or more segments nested within one another. The inner-most segment is pulled outward, away from the brush head, with the adjacent outer segments following forming a handle assembly. A resilient member within the brush head between the head and inner-most segment assists in extension of the handle assembly. Upon extension the segments form an interference fit with each adjacent interior and exterior segment forming a rigid handle assembly. When the handle assembly is in an extended configuration a retention member extends from the interior of the segment surrounding the extended segment for engaging the end of the segment thereby preventing the handle assembly from collapsing. A rotatable collar at the end of the inner-most segment includes filament for flossing teeth.

28 Claims, 17 Drawing Sheets

TOOTHBRUSH WITH AN EXTENDABLE HANDLE

CROSS-REFERENCE TO RELATED APPLICATIONS

This application is a continuation-in-part of U.S. application Ser. No. 15/006,323, filed Jan. 26, 2016, now abandoned, entitled "Toothbrush With An Extendable Handle," which is a continuation of U.S. application Ser. No. 14/554,921, filed Nov. 26, 2014, now U.S. Pat. No. 9,248,564, issued Feb. 2, 2016, entitled "Toothbrush With Collapsible Handle," the contents of which are hereby incorporated herein by reference.

BACKGROUND

The present disclosed subject matter relates generally to toothbrushes, and more particularly to a toothbrush with an extendable handle.

Poor oral hygiene can cause disease of the oral cavity which affects other parts of the body, such as the digestive system and circulatory system. Brushing of the teeth and other tissues of the oral cavity can remove such disease causing elements and organisms. Full sized toothbrushes are suitable for use at home, however, such brushes can become their own source of problems if they are allowed to retain disease causing organisms. Small, disposable toothbrushes are available for single use for cleaning the teeth of the oral cavity. Such products include a small head with bristles and a small fixed handle packaged in a foil package. Once the disposable toothbrush is used the entire toothbrush is discarded.

SUMMARY

A toothbrush that is small in size includes a head with an extendable handle assembly allowing the compact toothbrush to be stored in a small sealed plastic package until used. Puncturing the seal of the packaging allows access to the sterile collapsed toothbrush therein. The collapsed toothbrush has a brush head with bristles extending from one side, and an opening containing one or more segments nested within one another. The inner-most segment is pulled outward, away from the brush head, with the adjacent outer segments following. The segments are nested within one another and upon extension form an interference fit with each adjacent interior and exterior segment thereby forming a rigid handle assembly.

A filament, such as dental floss is contained within the toothbrush. An end of the filament extends from the end of the handle opposite the brush head, and when the handle is extended a user can pull the filament from the toothbrush and use the filament to floss their teeth.

In an embodiment, the inner most segment includes a conical member extending outward from the brush head providing structure for a user to grasp and for retaining the filament.

In an embodiment, the segments include a retention member that engages the end of each segment when the handle is in an extended configuration to prevent the collapse of the handle.

In an embodiment, the terminal segment includes a rotatable collar wound with filament for flossing teeth.

In an embodiment, the segments are extended from the nested position by a resilient member disposed within the brush head.

BRIEF DESCRIPTION OF THE DRAWINGS

The drawings constitute a part of this specification and include exemplary embodiments of the disclosed subject matter and illustrate various objects and features thereof.

DETAILED DESCRIPTION

Figure 1:
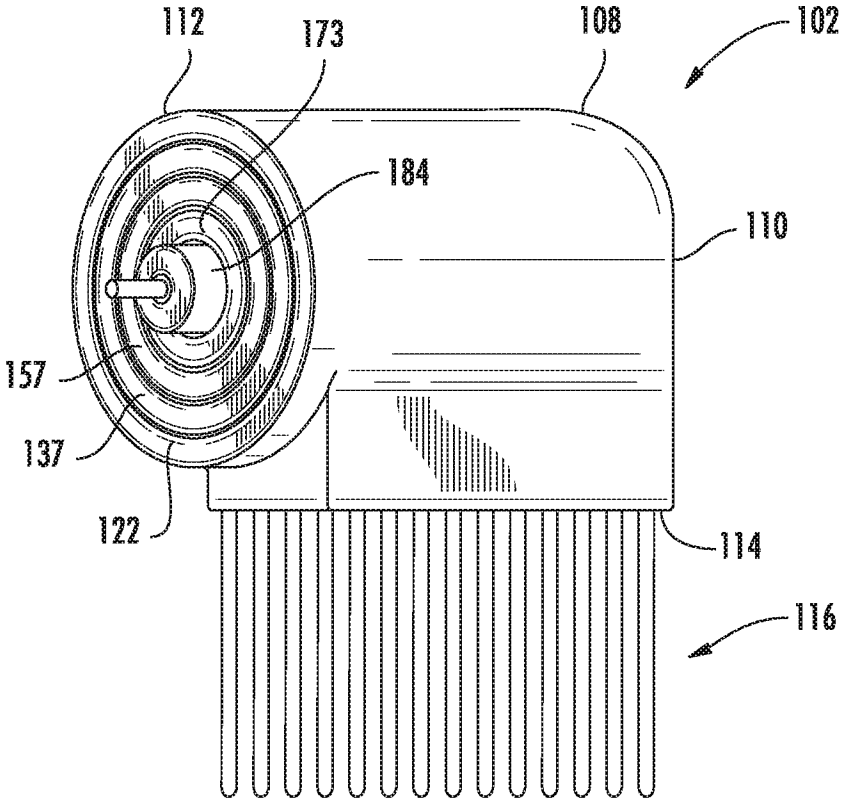
FIG. 1 is an isometric view of a toothbrush with a collapsible handle embodying principles of the disclosed subject matter with the handle in a collapsed configuration.
Figure 2:
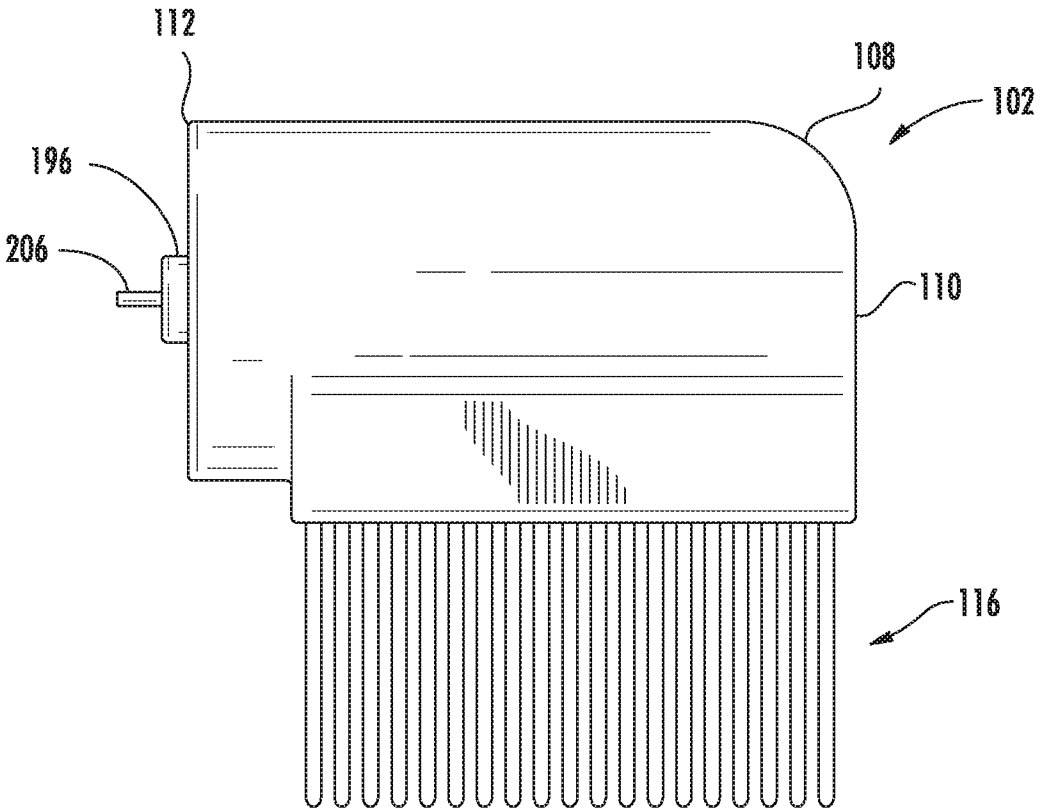
FIG. 2 is an elevation view of the toothbrush of FIG. 1.
Figure 3:
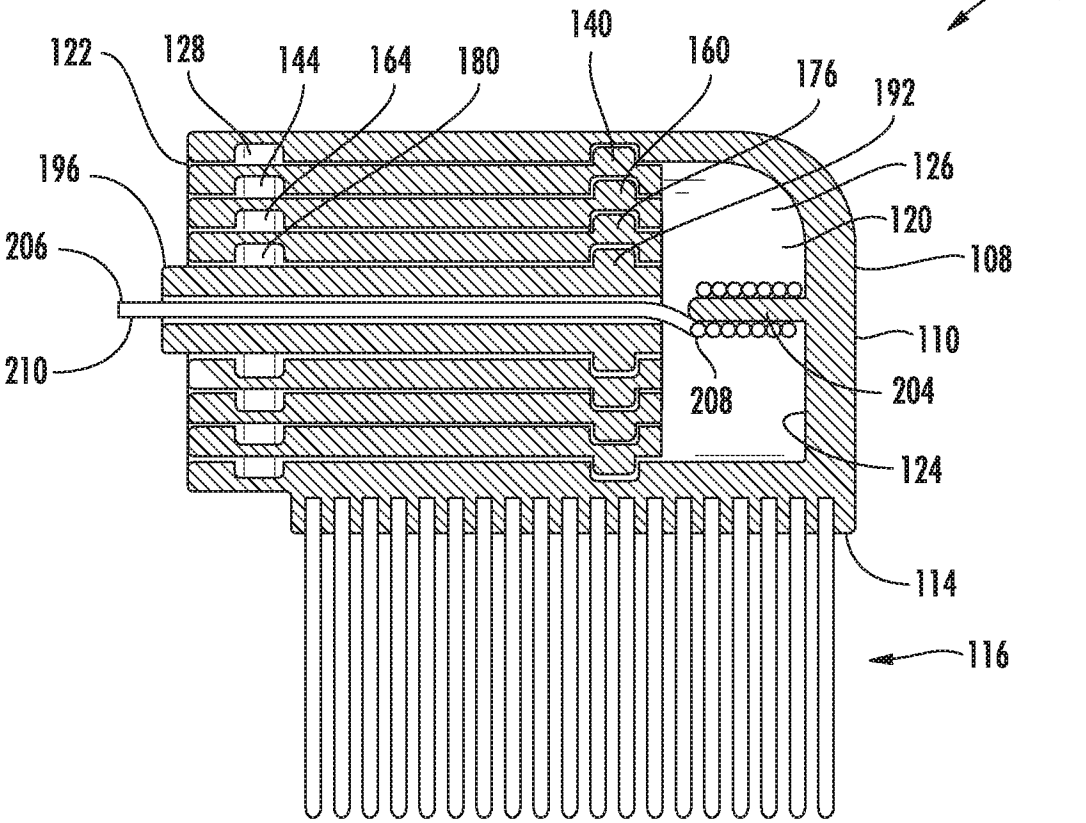
FIG. 3 is a cross-sectional view of the toothbrush of FIG. 2.
Figure 4:
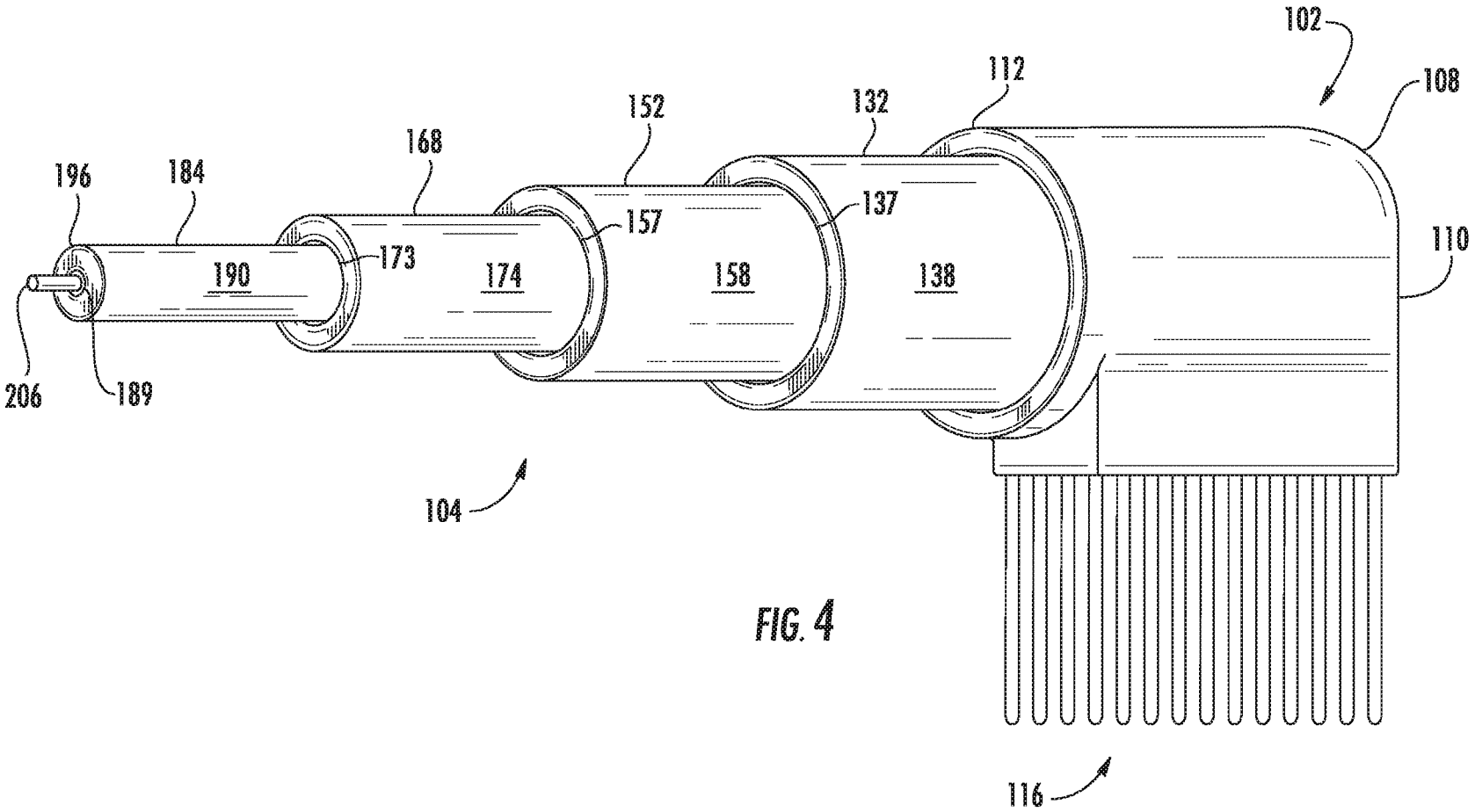
FIG. 4 is an isometric view of the toothbrush with the handle in an extended configuration.
Figure 5:
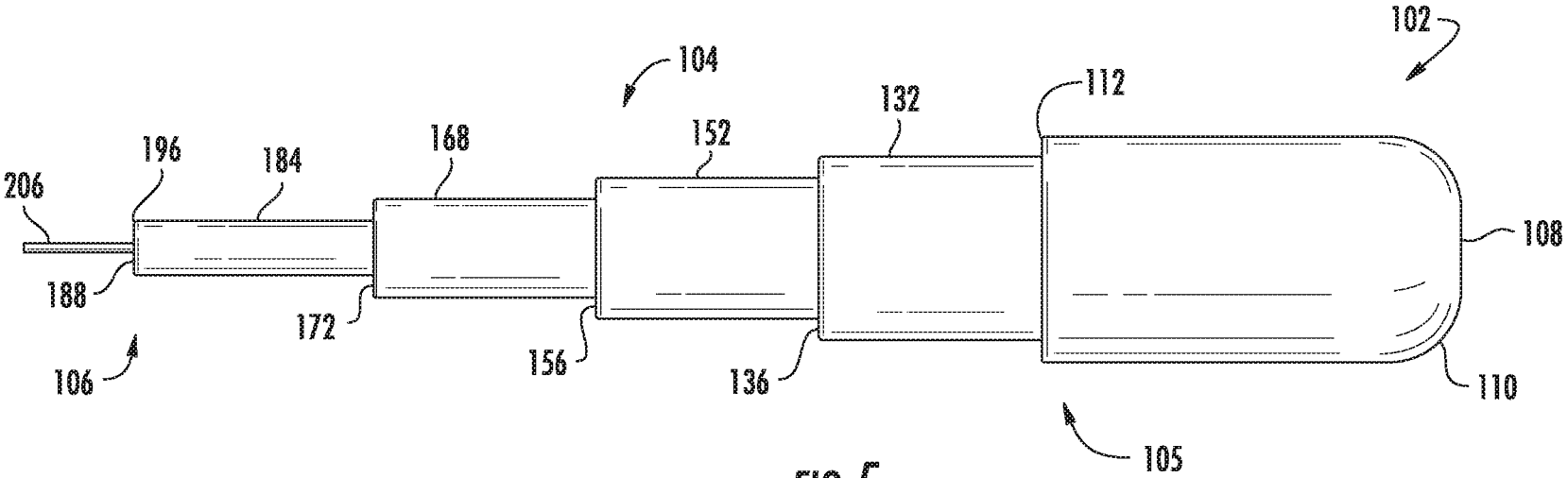
FIG. 5 is a top plan view of the toothbrush of FIG. 4.
Figure 6:
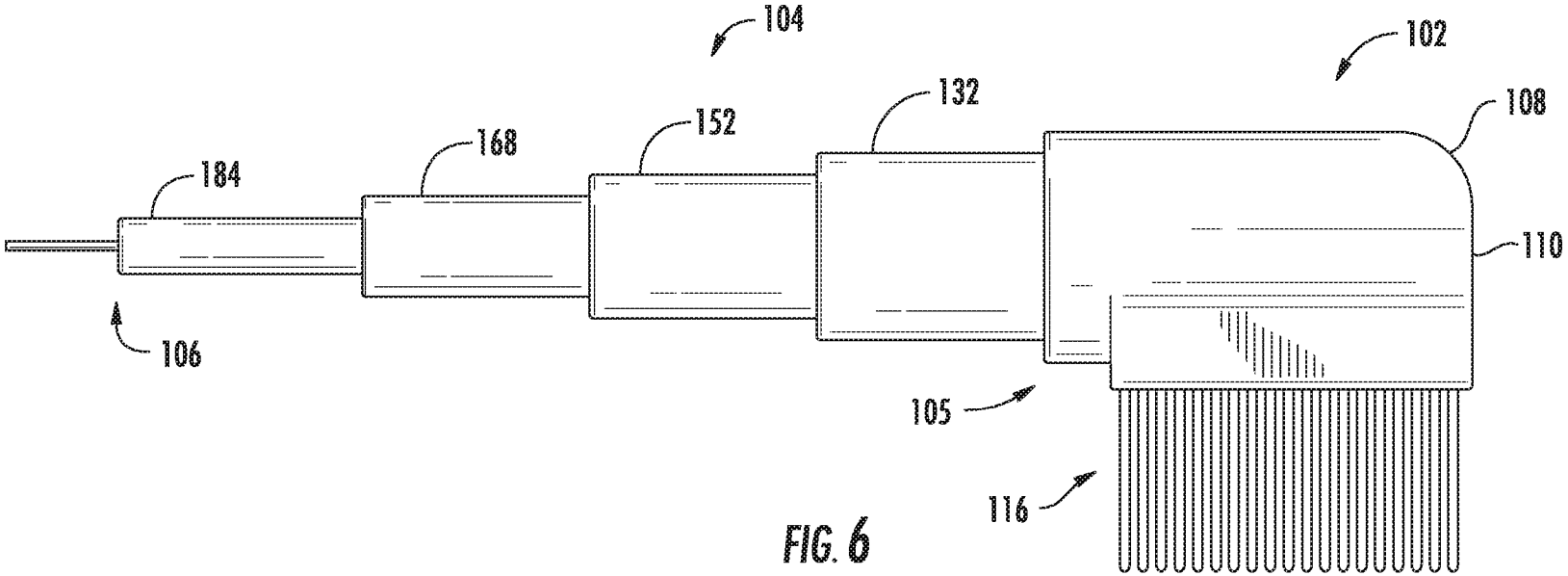
FIG. 6 is a side elevation view of the toothbrush of FIG. 4.
Figure 7:
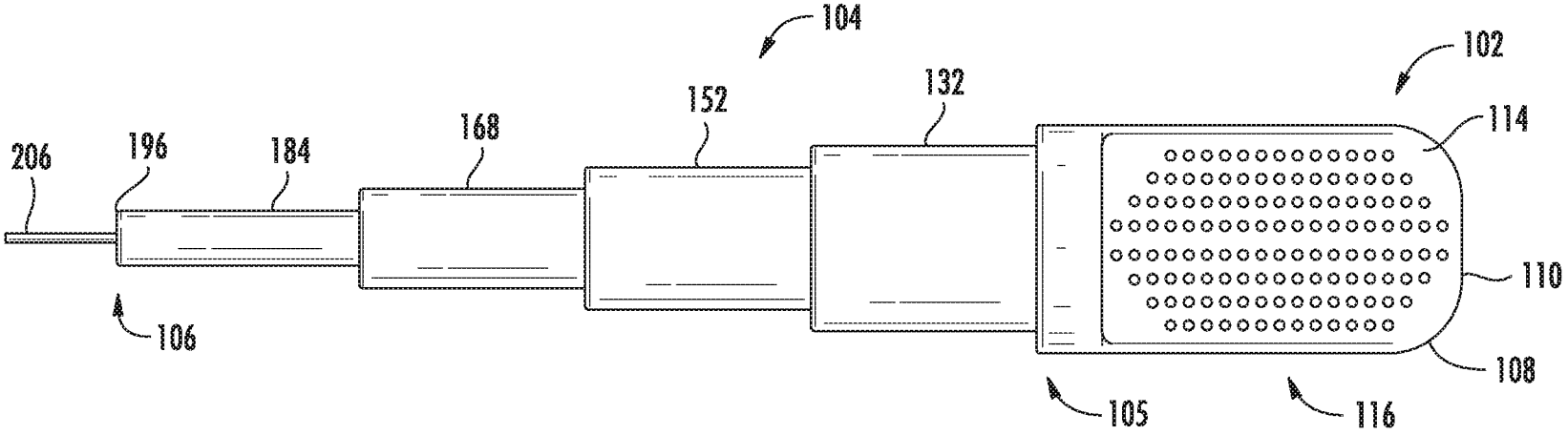
FIG. 7 is a bottom plan view of the toothbrush of FIG. 4.
Figure 8:
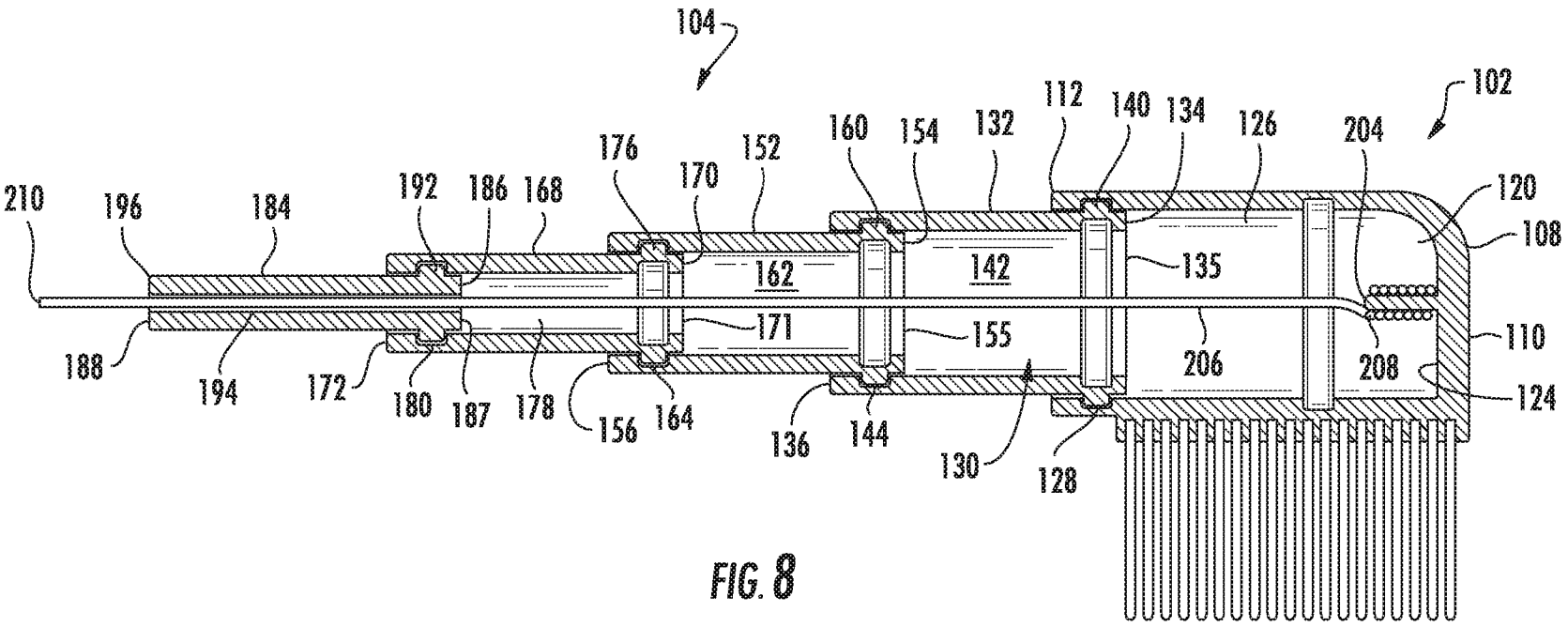
FIG. 8 is a cross-sectional view of the toothbrush of FIG. 6.

As required, detailed aspects of the disclosed subject matter are disclosed herein; however, it is to be understood that the disclosed aspects are merely exemplary of the disclosed subject matter, which may be embodied in various forms. Therefore, specific structural and functional details disclosed herein are not to be interpreted as limiting, but merely as a basis for the claims and as a representative basis for teaching one skilled in the art how to variously employ the disclosed technology in virtually any appropriately detailed structure.

Certain terminology will be used in the following description, and are shown in the drawings, and will not be limiting.

For example, up, down, front, back, right and left refer to the disclosed subject matter as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

Referring to the drawings, FIGS. 1-8 show an embodiment of a cleaning device or toothbrush 102 embodying principles of the disclosed subject matter. The toothbrush 102 includes a brush head 108 and a collapsible toothbrush handle 104 for mechanical removal of debris and organisms from the oral cavity. The toothbrush 102 is portable and disposable providing a convenient instrument for a user to maintain optimal oral hygiene. In an embodiment, the head 108 is manufactured from molded plastic.

The head 108 is generally small in size and extends from a first end 110 to a second end 112 forming a cavity 120. In an embodiment, the head 108 includes an opening 122 at the second end 112 and an opening at the first end 110. In an embodiment, the cavity 120 is formed from a front wall 124 opposite an opening 122, and a sidewall 126 there between. The front wall 124 forms a stud 204 extending therefrom. The cavity 120 has an interior cross sectional dimension. An engagement member in the sidewall 126 adjacent the opening 122 receives a complimentary engagement member at the first end 134 of a first segment 132. In an embodiment, the head 108 engagement member is a recess or a groove 128 in the sidewall 126 adjacent the opening 122, and the complimentary engagement member at the first end 134 of the first segment 132 is a protrusion 140. In an embodiment, the groove 128 is an annular groove in the sidewall 126. A plurality of bristles 116 extend outward from a bottom face 114 at the exterior of the head 108 for scouring teeth in an oral cavity. In an embodiment, the bristles 116 are manufactured from nylon and are plugged into holes in the head 108. In an embodiment, the bristles 116 are formed from the head 108 from a resilient and soft thermoplastic elastomer. In an embodiment, the bristles 116 are combined with flavoring or toothpaste, such as by coating or impregnating the bristles 116.

The handle 104 comprises one or more segments formed from plastic that are nested within one another. The segments may have a circular, oblong, elliptical, flat, rectangular, or polyhedral cross-section, or a combination thereof. In an embodiment, the handle 104 comprises segments 132, 152, 168, and 184. The first segment 132 extends from a first opening 135 at a first end 134 to a second opening 137 at a second end 136, forming a tubular member with a wall having an exterior 138 and an interior 142. In an embodiment, the exterior 138 first end 134 includes an engagement member and the interior 142 second end 136 includes an engagement member. In an embodiment, the engagement member of the first end 134 is a protrusion 140 extending from the exterior 138, and the engagement member of the second end 136 is a groove 144 at the interior 142. In an embodiment, the groove 144 is an annular groove in the wall. The cross-sectional dimension of the first segment 132 has an exterior and interior dimension defined by the exterior 138 and interior 142, respectively. The exterior dimension of the first segment 132 generally conforms to the interior cross-sectional dimension of the cavity 120.

A second segment 152 extends from a first opening 155 at a first end 154 to a second opening 157 at a second end 156, forming a tubular member with a wall having an exterior 158 and an interior 162. In an embodiment, the exterior 158 first end 154 includes an engagement member and the interior 162 second end 156 includes an engagement member, wherein the engagement member at the first end 154 is complimentary to the engagement member at the second end 136. In an embodiment, the engagement member of the first end 154 is a protrusion 160 extending from the exterior 158, and the engagement member of the second end 156 is a groove 164 at the interior 162. In an embodiment, the groove 164 is an annular groove in the wall. The cross-sectional dimension of the second segment 152 has an exterior and interior dimension defined by the exterior 158 and interior 162, respectively. The exterior dimension of the second segment 152 generally conforms to the interior cross-sectional dimension of the first segment 132.

A third segment 168 extends from a first opening 171 at a first end 170 to a second opening 173 at a second end 172, forming a tubular member with a wall having an exterior 174 and an interior 178. In an embodiment, the exterior 178 first end 170 includes an engagement member and the interior 178 second end 172 includes an engagement member, wherein the engagement member at the first end 170 is complimentary to the engagement member at the second end 156. In an embodiment, the engagement member of the first end 170 is a protrusion 176 extending from the exterior 174, and the engagement member of the second end 172 is a groove 180 at the interior 178. In an embodiment, the groove 180 is an annular groove in the wall. The cross-sectional dimension of the third segment 168 has an exterior and interior dimension defined by the exterior 174 and interior 178, respectively. The exterior dimension of the third segment 168 generally conforms to the interior cross-sectional dimension of the second segment 152.

A terminal or fourth segment 184 extends from a first opening 187 at a first end 186 to a second opening 189 at a second end 188, forming a tubular member with an exterior 190 and an interior 194. In an embodiment, the exterior 190 first end 186 includes an engagement member and the second end 188 forms the end of the handle 196, wherein the engagement member at the first end 186 is complimentary to the engagement member at the second end 172. In an embodiment, the engagement member of the first end 186 is a protrusion 192 extending from the exterior 190. A protrusion 192 extends from the exterior 190 adjacent the first end 186. The cross-sectional dimension of the fourth segment 184 has an exterior and interior dimension defined by the exterior 190 and interior 194, respectively. The exterior dimension of the fourth segment 184 generally conforms to the interior cross-sectional dimension of the third segment 168.

In an embodiment, the segment protrusions are elements intermittently spaced around the circumference of the exterior. In another embodiment, the protrusion is a continuous band element circumscribing the exterior.

In use, the handle 104 is extended outwardly from the head 108 to span a length between a first end 105 to a second end 106. Prior to extension, the handle 104 is in a collapsed configuration (FIGS. 1-3), whereby the first segment 132 is nested within the brush head 108, the second segment 152 is nested within the first segment 132, the third segment 168, is nested within the second segment 152, and the fourth segment 184 is nested within the third segment 168 giving the handle a compact form. The handle 104 is transitioned between a collapsed configuration to an extended configuration by moving the segments away from the head 108. The extended handle 104 forms a passage 130 extending between the cavity 120 and the second end 188 of the fourth segment 184. In the collapsed configuration, the second end 188 of the fourth segment 184 extends beyond the second end 172 of the third segment 168 providing sufficient structure for a user to grasp the segment and move the fourth segment 184 away from the head 108, extending the handle 104. When the handle 104 is in an extended configuration (FIGS. 4-8), the segments interlock by an interference fit between the protrusions and grooves forming a stiff handle 104 allowing a user to manipulate the head 108 about the teeth within the oral cavity. In an embodiment, the protrusions are formed from a resilient material allowing the protrusions to compress or deform when the handle 104 is in a collapsed configuration, and return to a decompressed or non-deformed configuration when exposed to its corresponding groove. In the extended configuration, the second segment 152 first end 154 is disposed between the third segment 168 first end 170 and first segment 132 first end 134, the third segment 168 first end 170 is disposed between the terminal or fourth segment 184 first end 186 and second segment 152 first end 154. The handle 104 is returned to the collapsed configuration by moving the segments inwardly toward the head 108. In an embodiment, once the protrusions engage their corresponding grooves, the handle 104 cannot return to a collapsed configuration.

Figure 9:
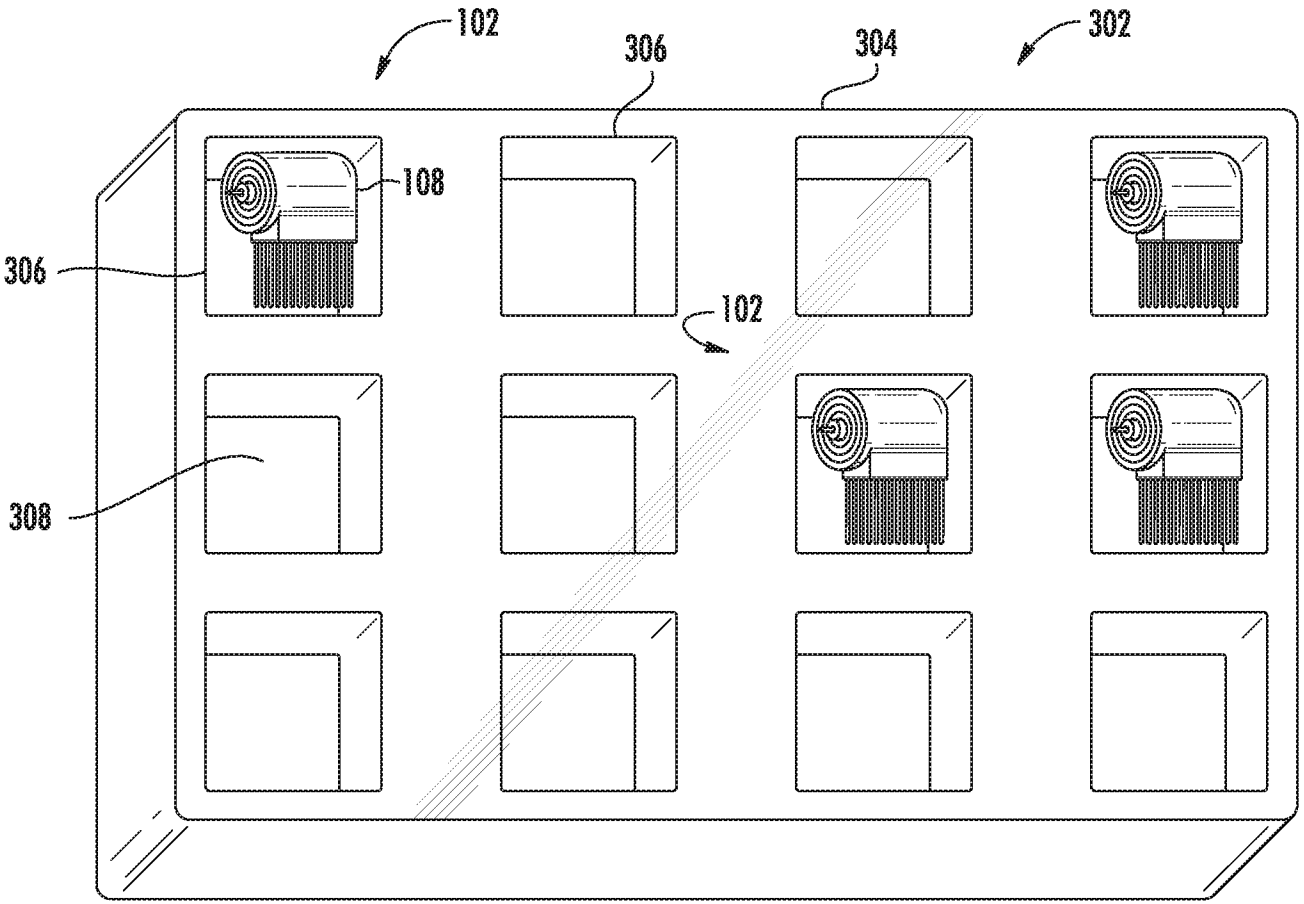
FIG. 9 is an isometric view of an embodiment of a package for dispensing the toothbrush with a collapsible handle.
Figure 10:
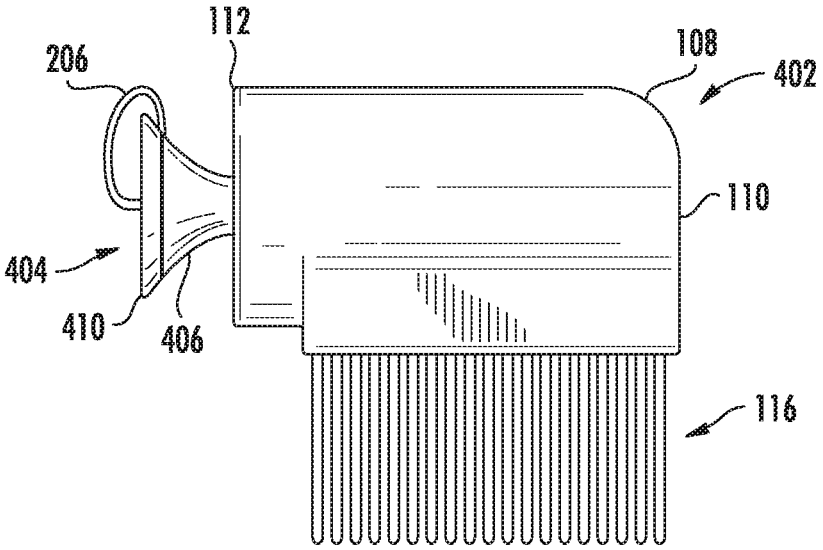
FIG. 10 is an elevation view of an alternative embodiment toothbrush with a collapsible handle embodying principles of the disclosed subject matter with the handle in a collapsed configuration.
Figure 11:
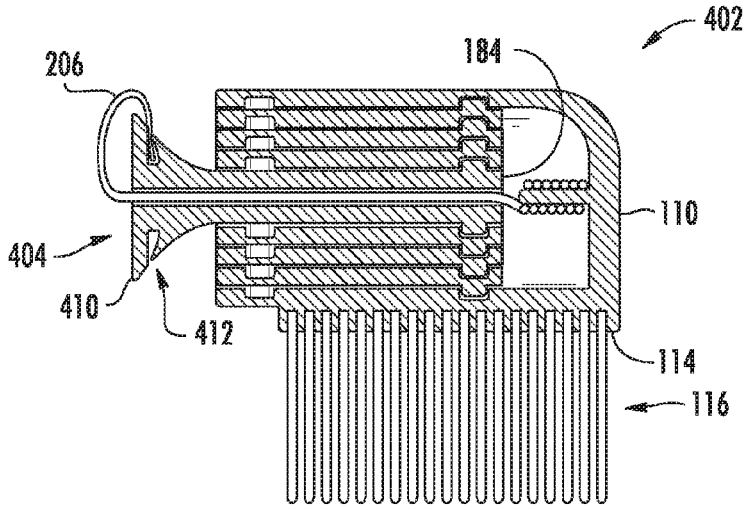
FIG. 11 is a cross-sectional view of the alternative embodiment toothbrush of FIG. 10.
Figure 12:
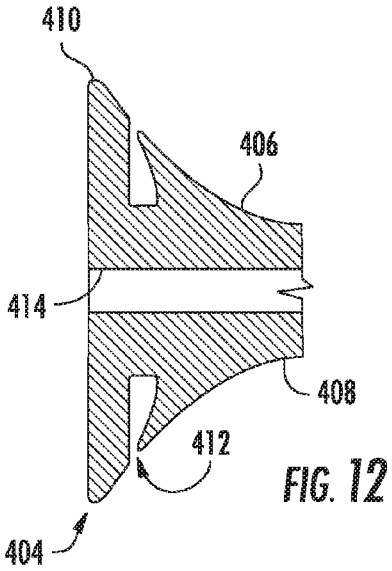
FIG. 12 is an enlarged cross-sectional view of the conical member.
Figure 13:
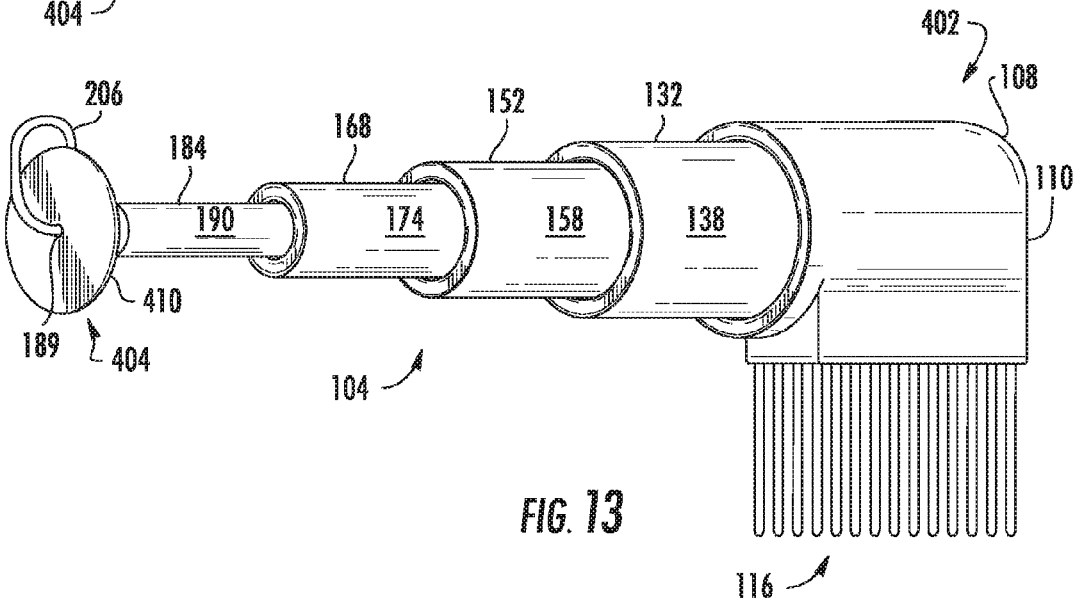
FIG. 13 is an isometric view of the alternative embodiment toothbrush with the handle in an extended configuration.

The toothbrush 102 can be stored in a package 302 until use. Referring to FIG. 9, the package 302 includes a tray 304 forming a plurality of compartments 306 sealed by a membrane 308. In an embodiment, a toothbrush 102 is sealed in a compartment 306 until use.

In an alternative embodiment, the toothbrush 102 includes a filament 206, including dental floss, for cleaning between the teeth of a user. In an embodiment, the filament 206 extends between a first end 208 within the handle to a second end 210 at the exterior 190 of the toothbrush 102. In an embodiment, the filament 206 extends from a first end 208 at the stud 204 to a second end 210 at the exterior 190 of the toothbrush 102. In an embodiment, the second end 210 is adhered to the exterior 190 of the terminal segment by an adhesive. When the toothbrush 102 is in a collapsed configuration a portion of the filament 206 is about the stud 204. Upon extension of the handle 104 the filament 206 extends from the stud 204 through the passage 130 to the exterior 190 of the fourth segment 184. In an embodiment, the filament 206 is wound around the stud. A user can grasp the second end 210 and pull the filament 206 off of the stud 204 separating the filament 206 from the toothbrush 102 for use when the toothbrush 102 is in either a collapsed configuration or an extended configuration.

In an embodiment, each engagement member and its corresponding engagement member on the adjacent segment or head of the toothbrush 102, as the case may be, are complimentary in configuration.

In an embodiment, each groove and its corresponding protrusion of the toothbrush 102 are complimentary in conformation.

In an embodiment, the various grooves of the toothbrush 102 may be protrusions, and the various protrusions of the toothbrush 102 are complimentary grooves. For example, the groove 128 of the brush head 108 is a protrusion, and the protrusion 140 of the first segment is a groove complimentary of the brush head protrusions, providing an interference fit.

In an embodiment, the head 108 and segments do not have grooves, and the segments do not have protrusions; the various segments are nested within one another and the head 108 when the handle 104 is in a collapsed configuration, and the exterior wall first ends of each inner segment form an interference fit with the interior wall of its corresponding outer segment second end when the segments are moved outward away from the head 108 and the handle 104 is in an extended configuration.

Figure 14:
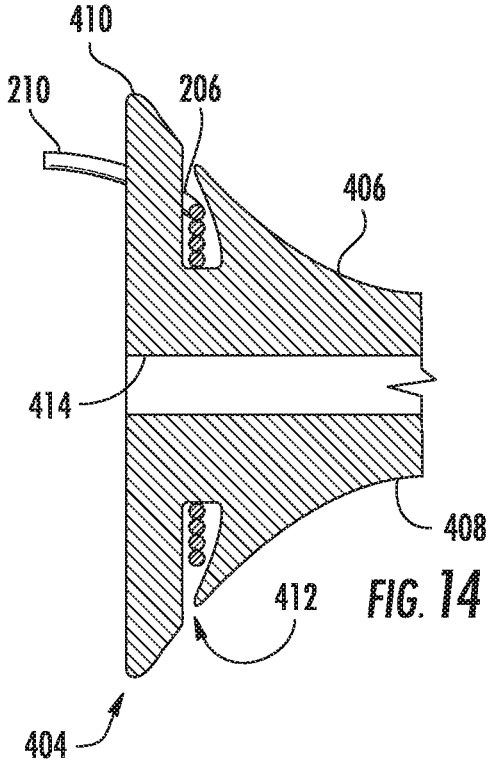
FIG. 14 is an enlarged cross-sectional view of the conical member with a filament wound around the core.

Referring to FIGS. 10-14, an alternative embodiment cleaning device or toothbrush 402 embodying principles of the disclosed subject matter is shown. The second end 188 of the terminal or fourth segment 184 forms a conical member 404 providing structure for a user to grasp the segment and move the fourth segment 184 away from the head 108. In addition, the conical member 404 allows attachment of the second end 210 of the filament 206. The conical member 404 includes a sidewall 406 extending outward from a narrow first end 408 to a broad circular second end 410. The sidewall 406 forms an annular groove 412 adjacent the second end 410 having a depth and a width for receiving the second end 210. The depth of the groove 412 terminates prior to the interior 194 forming a core 414 of material providing structural support to the conical member 404. In an embodiment, the width of the groove 412 provides an interference fit with the second end 210 of the filament 206. In an embodiment, the width of the groove 412 allows the filament 206 to be freely wound around the core 414. In an embodiment, the entirety of the filament 206 is wound around the core 414 and not retained within the brush head 108 or within the handle (FIG. 14).

Figure 15:
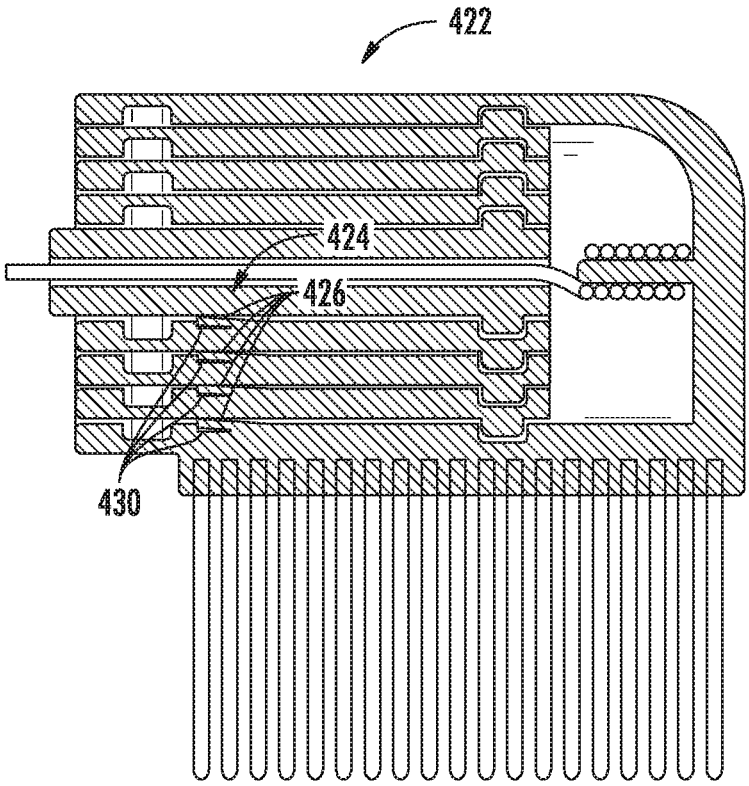
FIG. 15 is a cross-sectional view of an alternative embodiment toothbrush with a collapsible handle embodying principles of the disclosed subject matter with the handle in a collapsed configuration and the projections in a compressed configuration.
Figure 16:
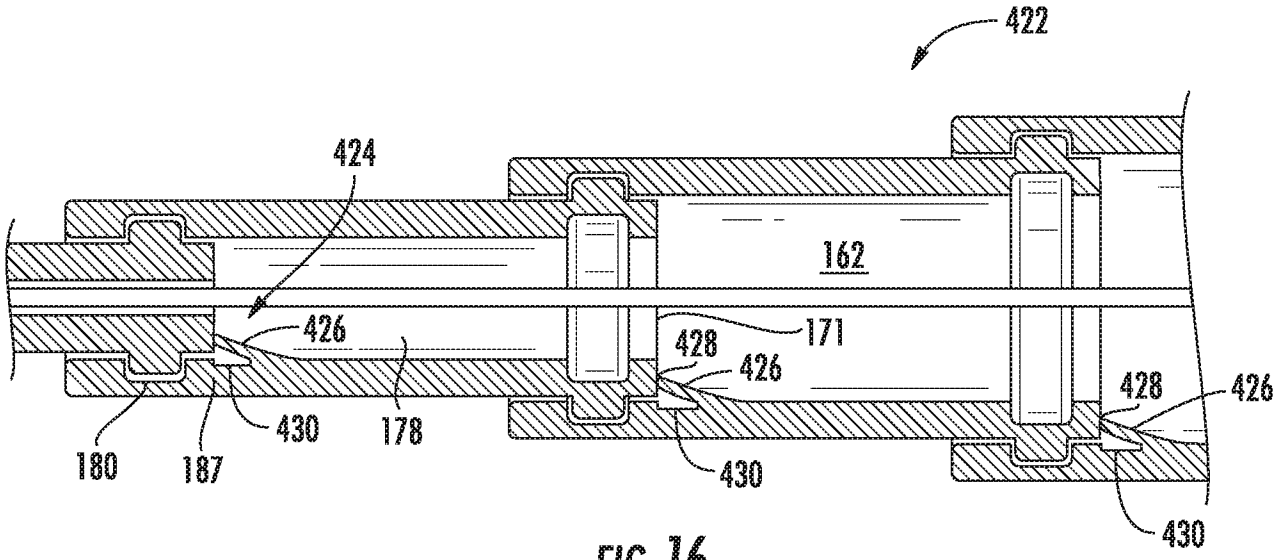
FIG. 16 is a cross-sectional view of the alternative embodiment toothbrush with the handle in an extended configuration and the projections in an uncompressed configuration.

Referring to FIGS. 15-16, an alternative embodiment cleaning device or toothbrush 422 embodying principles of the disclosed subject matter is shown. The interior sidewall of the brush head and interior wall of the segments include a retention member 424 comprising a projection 426 or barb that extends into the interior of the segment from a notch 430 for retaining the handle 104 in an extended configuration. Referring to FIG. 15, the handle 104 is shown in a collapsed configuration with notches 430 and projections 426 adjacent grooves 128, 144, 164, 180. In an embodiment, the interior wall forms the notch 430 and projection 426. The projection 426 has resilient qualities extends from a base to a tip 428 orientated toward the second end of the corresponding toothbrush 424 element. In an embodiment, brush head 108 and segments 132, 152, and 168 have one retention member 424. In an embodiment, the brush head 108 and segments 132, 152, and 168 have a plurality of retention members 424.

The notch 430 is dimensioned to receive the projection 426 when the projection 426 is in a compressed state. In FIG. 15 the projection 426 is in a partially compressed state. When the handle 104 is moved from the collapsed configuration (FIG. 15) to the extended configuration (FIG. 16), the protrusions seat within their respective grooves and the retention member 424 transitions from a compressed state to a decompressed state with the tip 428 extending into the passage 130 thereby preventing the handle 104 from being returned to the collapsed configuration. In an embodiment, an audible click sound is heard as the retention member 424 decompresses. As the first segment 132 is transitioned from a collapsed configuration to an extended configuration the protrusion 140 passes over a first retention member 424 and into the groove 128. When the first end 134 passes the tip 428 the projection 426 is no longer under compression and the tip 428 extends into the passage 130 and engages the first end 134 preventing the first segment 132 from being moved back into the brush head 108. As the second segment 152 is transitioned from a collapsed configuration to an extended configuration the protrusion 140 passes over a second retention member 424 and into the groove 144. When the first end 154 passes the tip 428 the projection 426 is no longer under compression and the tip 428 extends into the passage 130 and engages the first end 154 preventing the second segment 152 from being moved back into the first segment 132. As the third segment 168 is transitioned from a collapsed configuration to an extended configuration the protrusion 176 passes over a third retention member 424 and into the groove 164. When the first end 170 passes the tip 428 the projection 426 is no longer under compression and the tip 428 extends into the passage 130 and engages the first end 170 preventing the third segment 168 from being moved back into the second segment 152. As the terminal or fourth segment 184 is transitioned from a collapsed configuration to an extended configuration the protrusion 192 passes over a fourth retention member 424 and into the groove 180. When the first end 186 passes the tip 428 the projection 426 is no longer under compression and the tip 428 extends into the passage 130 and engages the first end 186 preventing the fourth segment 184 from being moved back into the third segment 168.

Figure 17:
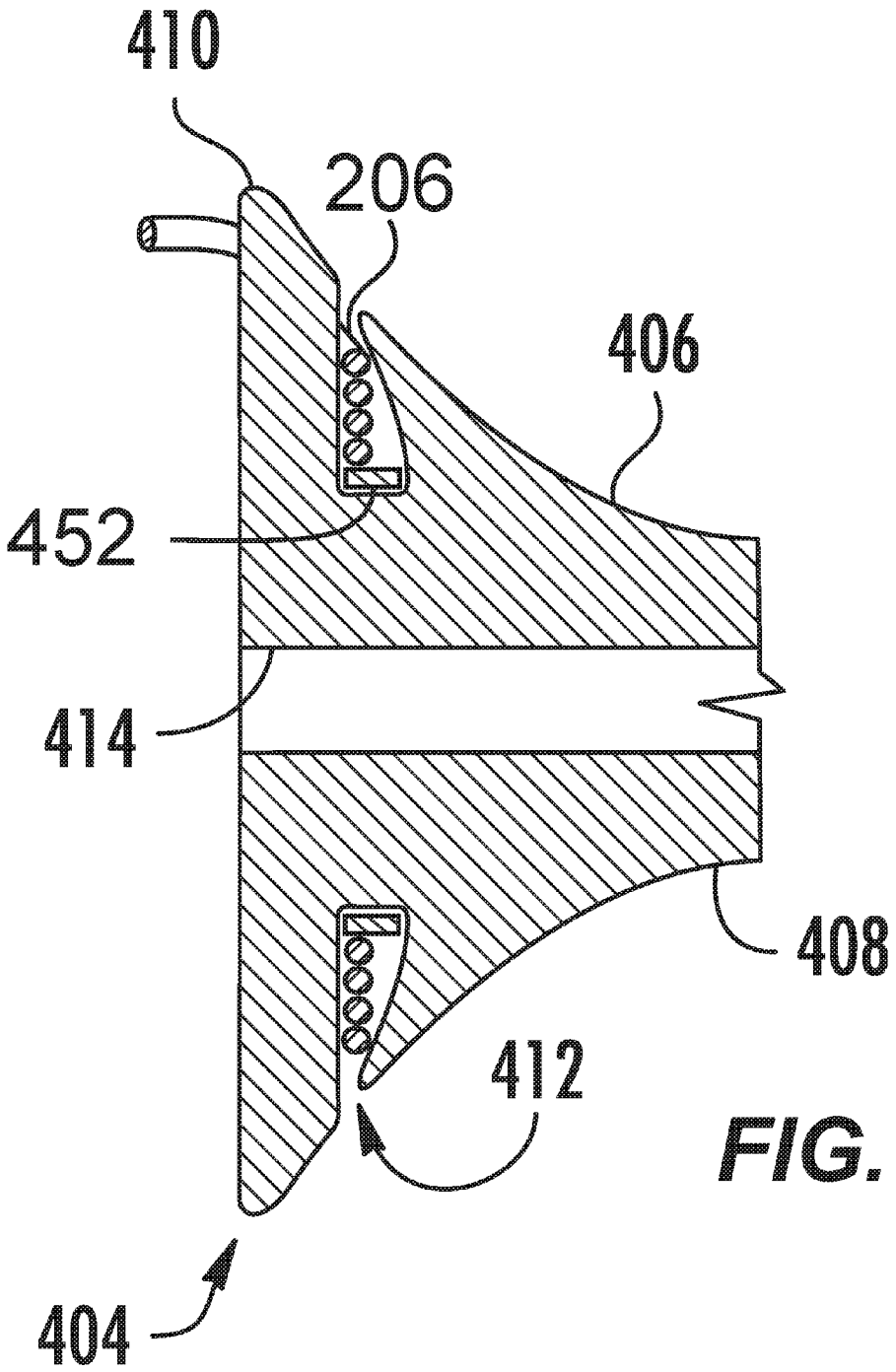
FIG. 17 is an enlarged cross-sectional view of the conical member with a filament wound around a collar that rotates around the core.

In an embodiment, filament 206 is wound around a collar 452 rotatable about the second end 188 of the terminal or fourth segment 184 of a toothbrush. Referring to FIG. 17, an embodiment of a cleaning device or toothbrush 402 embodying principles of the disclosed subject matter is shown and described with filament 206 wound around a collar 452 rotatable about the annual groove 412.

Figure 18:
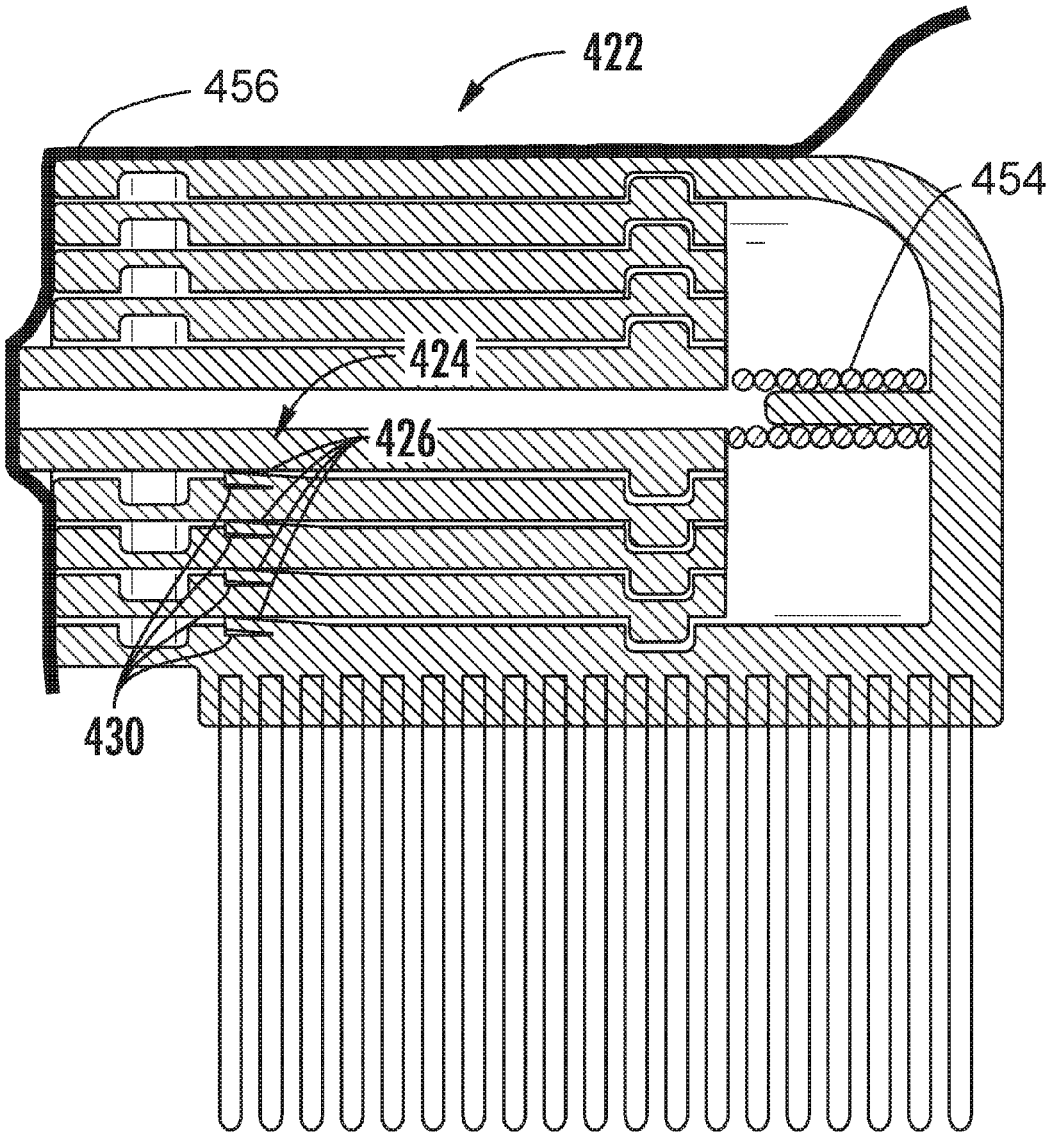
FIG. 18 is a cross-sectional view of a toothbrush with a spring in a compressed position in the head.

In an embodiment, a resilient member or spring 454 is disposed within the brush head 108 of the toothbrush 102 between the internal sidewall of the brush head 108 and the first end of the terminal segment. In an embodiment the spring 454 is helical. Referring to FIG. 18, the spring 454 is shown in a compressed state about the stud 204, and the segments are in a first position. In an embodiment, the spring 454 is in a fully compressed state when the terminal segment is in the first position. In an embodiment, the spring 454 is in a partially compressed state when the terminal segment is in the first position. A first end of the spring 454 is at the front wall 124, and a second end of the spring 454 is at the first end 186 of the terminal or fourth segment 184. In an embodiment, an adhesive member 456, including a sticker, adhesively contacts the second ends of the segments when the collapsible toothbrush handle 104 is in a collapsed configuration, and the adhesive member 456 extends across part of the brush head 108 in adhesive contact therewith retaining the segments in the collapsed configuration against the force of the spring 454. The adhesive member 456 is removed by the user before using the toothbrush 102 allowing the spring 454 to uncompress and extend the handle 104.

Figure 19:
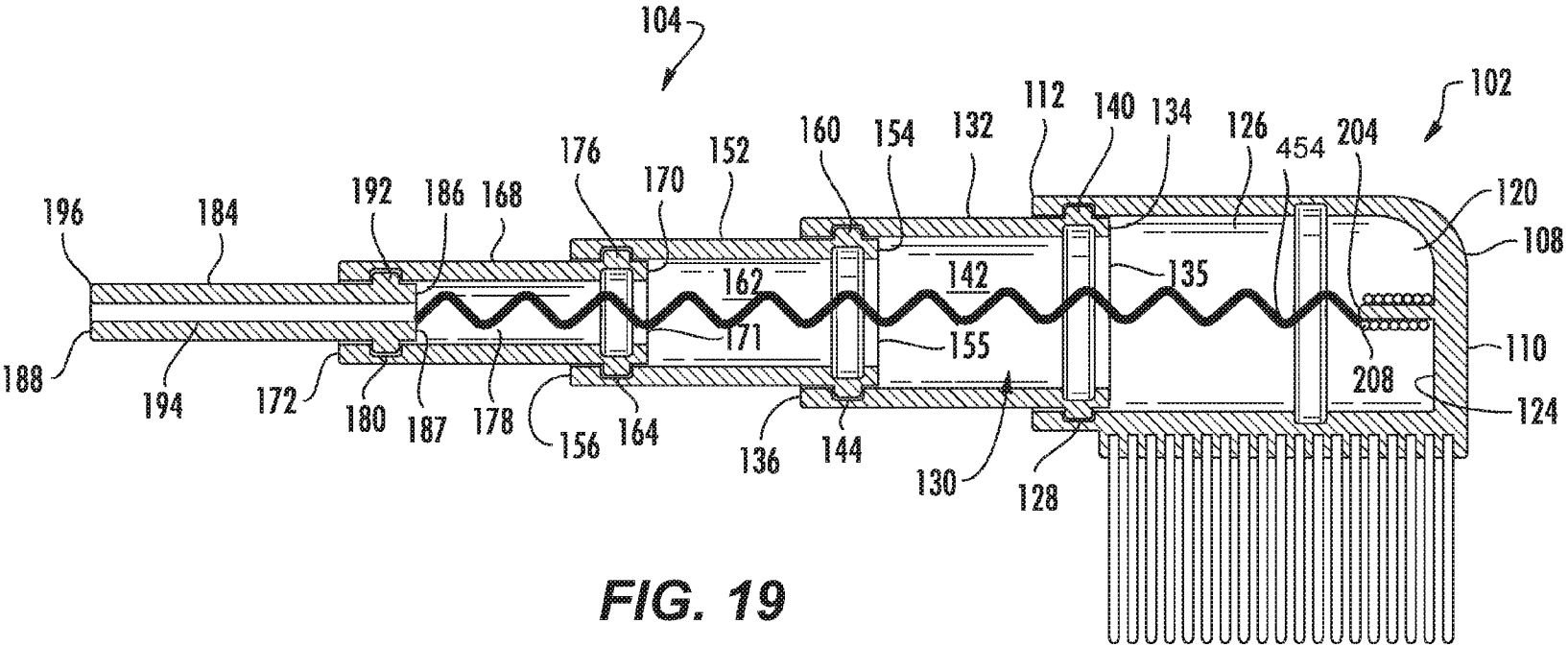
FIG. 19 is a cross-sectional view of the toothbrush of FIG. 18 with the spring in an uncompressed position and the toothbrush handle extended.

Referring to FIG. 19, the spring 454 is shown in an uncompressed state whereby the collapsible toothbrush handle 104 is fully extended, and the segments are in a second position whereby the various engagement members at the first end of the segments are disposed within the engagement members at the second end of the adjacent outer segment. In an embodiment, the spring 454 is in a fully uncompressed state when the terminal segment is in the second position. In an embodiment, the spring 454 is in a partially uncompressed state when the terminal segment is in the second position.

It will be appreciated that the collapsible toothbrush handle 104 can be used for various other applications. Moreover, the collapsible toothbrush handle 104 can be fabricated in various sizes and from a wide range of suitable materials, using various manufacturing and fabrication techniques.

It is to be understood that while certain aspects of the disclosed subject matter have been shown and described, the disclosed subject matter is not limited thereto and encompasses various other embodiments and aspects.

The invention claimed is:

1. A toothbrush, comprising:

a hollow brush head forming an internal sidewall and an opening;

at least one segment movably disposed within the brush head, comprising:

a tubular member with a wall having an exterior, the tubular member extending between a first end and a second end;

a resilient member disposed between the internal sidewall and the at least one segment first end;

wherein when the at least one segment is in a first position the at least one segment extends within the brush head, and the resilient member is in a compressed state; and wherein when the at least one segment is in a second position the exterior wall of the at least one segment forms an interference fit with the internal sidewall of the brush head opening, and the resilient member is in an un-compressed state.

2. The toothbrush of claim 1, further comprising:

a first engagement member at the brush head internal sidewall;

a second engagement member at the at least one segment exterior adjacent the first end; and wherein when the at least one segment is in the second position the first engagement member engages the second engagement member.

3. The toothbrush of claim 2, wherein:

the first engagement member is a protrusion; and the second engagement member is a groove.

4. The toothbrush of claim 2, wherein:

the first engagement member is a groove; and the second engagement member is a protrusion.

5. The toothbrush of claim 4, wherein the groove is an annular groove.

6. The toothbrush of claim 4, wherein the groove within the brush head is complimentary in configuration to the protrusion of the at least one segment.

7. The toothbrush of claim 1, further comprising:

a package, comprising:

a tray forming a compartment; and a membrane sealing the compartment; and wherein the toothbrush with the at least one segment in the first position is sealed within the compartment.

8. The toothbrush of claim 1, wherein the brush head internal sidewall includes a retention member engaging the at least one segment in the second position preventing movement of the at least one segment into the brush head.

9. The toothbrush of claim 8, wherein the retention member comprises a projection formed from the brush head internal sidewall and extending into the interior of the segment forming a tip.

10. The toothbrush of claim 9, wherein the projection tip engages the first end of the first segment.

11. The toothbrush of claim 1, further comprising:

a rotatable collar about the at least one segment second end; and a filament wound about the rotatable collar.

12. The toothbrush of claim 1, wherein the resilient member is a helical spring.

13. The toothbrush of claim 1, further comprising an adhesive member in contact with the at least one segment second end and the brush head.

14. A toothbrush, comprising:
a brush head; and
an extendable handle assembly connected to the brush head, comprising:
a first segment, comprising:
a tubular member with a wall having an exterior and an interior, the wall extending between a first end and a second end forming a passage; and
a first engagement member at the wall interior adjacent the second end;
a second segment movably disposed within the first segment, comprising:
a tubular member with a wall having an exterior and an interior, the wall extending between a first end and a second end; and
a second engagement member at the wall exterior adjacent the first end;
a resilient member disposed between the brush head and the second segment first end;
wherein when the second segment is in a first position the first engagement member is disengaged from the second engagement member, and the resilient member is in a compressed state;
wherein when the second segment is in a second position the first engagement member engages the second engagement member forming a handle assembly, and the resilient member is in an uncompressed state.

15. The toothbrush of claim 14, wherein:
the first engagement member is a groove; and
the second engagement member is a protrusion.

16. The toothbrush of claim 15, wherein the groove is an annular groove.

17. The toothbrush of claim 14, further comprising:
a package, comprising:
a tray forming a compartment; and
a membrane sealing the compartment; and
wherein the toothbrush is sealed within the compartment.

18. The toothbrush of claim 14, wherein the first segment interior wall includes a retention member engaging the second segment in the second position preventing movement of the second segment into the first segment.

19. The toothbrush of claim 18, wherein the retention member comprises a projection formed from the wall interior extending into the interior of the first segment forming a tip for engaging the first end of the first segment.

20. The toothbrush of claim 14, further comprising:
a rotatable collar about the second segment second end; and
a filament wound about the rotatable collar.

21. The toothbrush of claim 14, wherein the resilient member is a helical spring.

22. The toothbrush of claim 14, further comprising an adhesive member in contact with the second segment second end and the brush head.

23. A toothbrush, comprising:
a brush head; and
an extendable handle assembly connected to the brush head, comprising:
a first segment, comprising:
a tubular member with a wall having an exterior and an interior, the wall extending between a first end and a second end; and
a retention member formed from the wall interior;
a second segment movably disposed within the first segment, comprising:
a tubular member with a wall having an exterior and an interior, the wall extending between a first end and a second end;
a resilient member disposed between the brush head and the second segment first end;
wherein when the handle assembly is in a collapsed configuration the retention member is compressed, and the resilient member is in a compressed state; and
wherein when the handle assembly is in an extended configuration the resilient member is in an uncompressed state, and the retention member extends into the interior of the first segment engaging the end of the second segment preventing movement of the second segment into the first segment.

24. The toothbrush of claim 23, further comprising:
a package, comprising:
a tray forming a compartment; and
a membrane sealing the compartment; and
wherein the toothbrush with the handle assembly in a collapsed configuration is sealed within the compartment.

25. The toothbrush of claim 23, wherein when the first segment and second segment are in the extended configuration the exterior wall of the first end of the second segment forms an interference fit with the interior wall of the first segment second end.

26. The toothbrush of claim 23, further comprising:
a rotatable collar about the second segment second end; and
a filament wound about the rotatable collar.

27. The toothbrush of claim 23, wherein the resilient member is a helical spring.

28. The toothbrush of claim 23, further comprising an adhesive member in contact with the second segment second end and the brush head.

* * * * *